US009931553B1

(12) United States Patent
Ware

(10) Patent No.: US 9,931,553 B1
(45) Date of Patent: Apr. 3, 2018

(54) GOLF CLUB CADDY

(71) Applicant: Nolan Ware, Powder Springs, GA (US)

(72) Inventor: Nolan Ware, Powder Springs, GA (US)

( * ) Notice: Subject to any disclaimer, the term of this patent is extended or adjusted under 35 U.S.C. 154(b) by 120 days.

(21) Appl. No.: 15/019,202

(22) Filed: Feb. 9, 2016

(51) Int. Cl.
*A63B 55/00* (2015.01)
*A63B 55/10* (2006.01)

(52) U.S. Cl.
CPC ..... *A63B 55/10* (2013.01)

(58) Field of Classification Search
CPC ..... A63B 55/00; A63B 55/10; A63B 55/007; A63B 55/008; A63B 55/005
USPC ..... 206/315.1–315.8; 280/646, 30; 473/286
See application file for complete search history.

(56) References Cited

U.S. PATENT DOCUMENTS 2,987,109 A 6/1961 Sohmer
5,632,496 A * 5/1997 Nelson ..... A63B 53/00 206/315.3
6,032,999 A 3/2000 York
6,464,090 B1 10/2002 Martinez
6,471,055 B1 10/2002 Kwiecienski
7,854,664 B1 12/2010 Comrie
8,066,119 B2 11/2011 Doman
D659,788 S 5/2012 VanNostran
8,201,686 B2 * 6/2012 McGuire ..... A63B 55/408 206/206
2008/0135431 A1 * 6/2008 Tan ..... A63B 55/00 206/315.7
2010/0320106 A1 * 12/2010 McGuire ..... A63B 55/53 206/315.7
2011/0215013 A1 9/2011 Young
2013/0105341 A1 * 5/2013 Whitworth ..... A63B 55/00 206/315.6

* cited by examiner

*Primary Examiner* — Fenn C Mathew
*Assistant Examiner* — Cynthia Collado
(74) *Attorney, Agent, or Firm* — Kyle A. Fletcher, Esq.

(57) ABSTRACT

This disclosure assists a golfer in these situations. The golf club caddy is adapted to be used in the game of golf. The golf club caddy is a lightweight, portable carrier that is used to carry a plurality of golf clubs as well as a plurality of accessories that may be required by the golfer. The golf club caddy is a self-supporting structure that with sub-structures that are designed to carry the plurality of golf clubs, one or more towels, one or more golf balls, and tools such as range finders or GPS locators. The golf club caddy comprises a plurality of club holders, a container, a cylinder, a plurality of legs, and a leg opening mechanism.

11 Claims, 6 Drawing Sheets

GOLF CLUB CADDY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of apparatus for physical training, more specifically, carrier for golf clubs.

Golf is inherently a game of variety. Differences in the strategic decisions and selected shot execution made by players during the play of the game will often result in a plurality of golf balls being spread broadly over the field of play. Unfortunately, it is often the case that course conditions will require that golf carts follow restricted paths that may be inconsistent with the previously executed plan of the golfer. In these instances, a golfer must approach their next shot on foot which forces them to prepare for their shot at the cart without a complete knowledge of the specifics of distance and ball position that are required for selecting the club or other preparations that may be required in executing the next shot. In these instances, golfers are often compelled to carry a plurality of clubs and accessories in their hands running the risk of losing equipment or not being able to carry adequate equipment to insure that the golfer is adequately prepared for their next shot.

SUMMARY OF INVENTION

This disclosure assists a golfer in these situations. The golf club caddy is adapted to be used in the game of golf. The golf club caddy is a lightweight, portable carrier that is used to carry a plurality of golf clubs as well as a plurality of accessories that may be required by the golfer. The golf club caddy is a self-supporting structure that with sub-structures that are designed to carry the plurality of golf clubs, one or more towels, one or more golf balls, and tools such as range finders or GPS locators.

These together with additional objects, features and advantages of the golf club caddy will be readily apparent to those of ordinary skill in the art upon reading the following detailed description of the presently preferred, but nonetheless illustrative, embodiments when taken in conjunction with the accompanying drawings.

In this respect, before explaining the current embodiments of the golf club caddy in detail, it is to be understood that the golf club caddy is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the golf club caddy.

It is therefore important that the claims be regarded as including such equivalent construction insofar as they do not depart from the spirit and scope of the golf club caddy. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
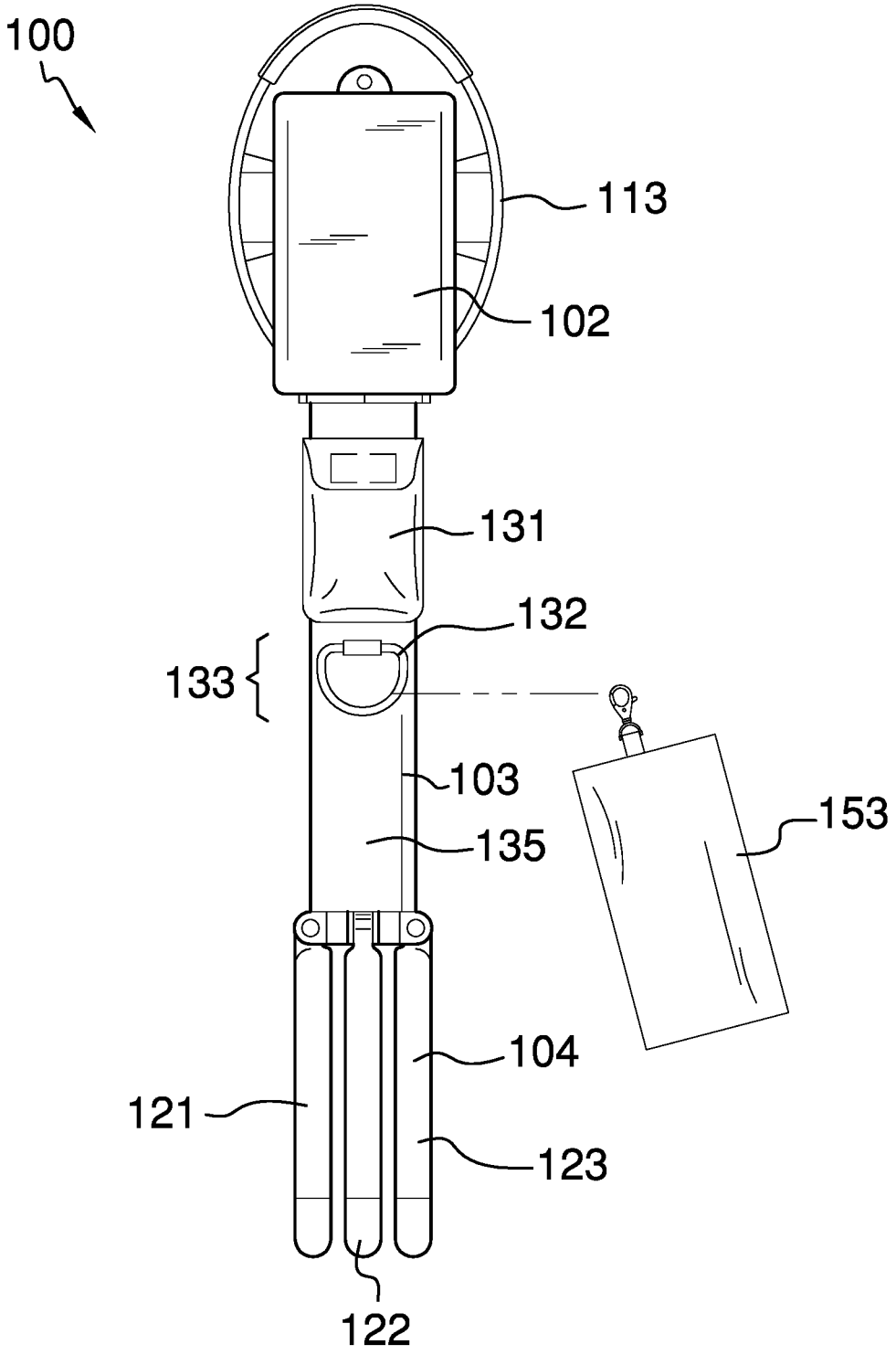
FIG. 1 is a front view of an embodiment of the disclosure.
Figure 2:
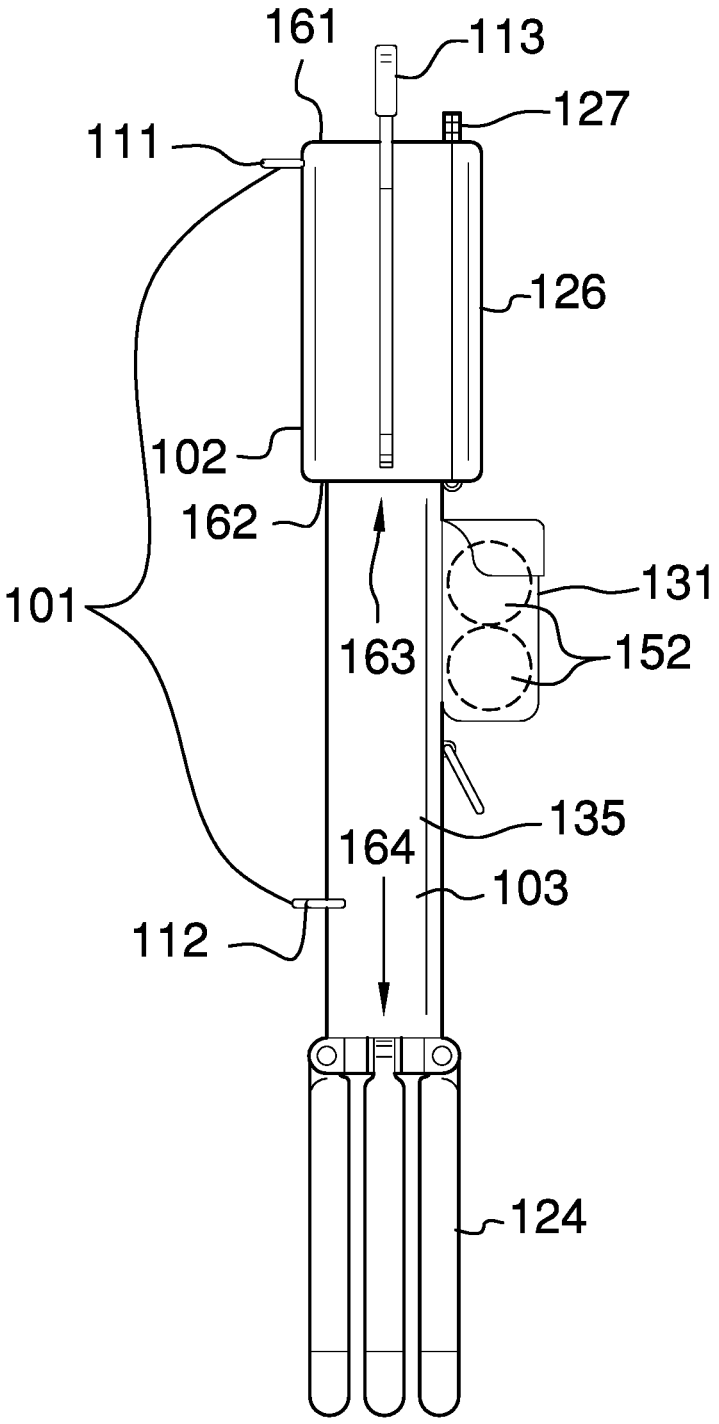
FIG. 2 is a side view of an embodiment of the disclosure.
Figure 3:
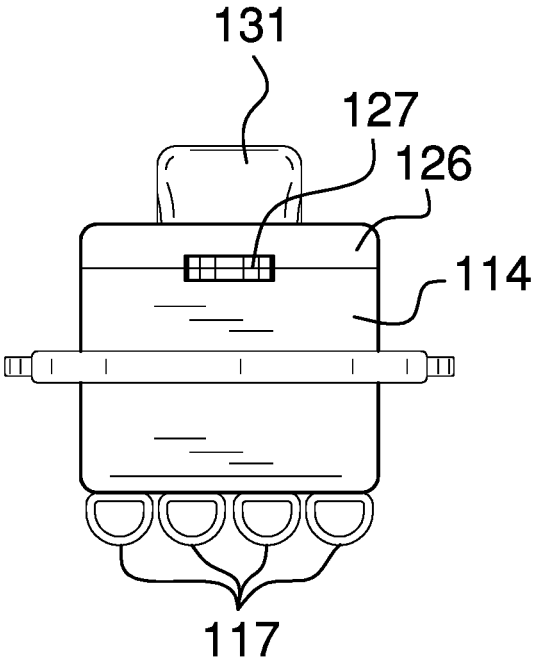
FIG. 3 is a top view of an embodiment of the disclosure.
Figure 4:
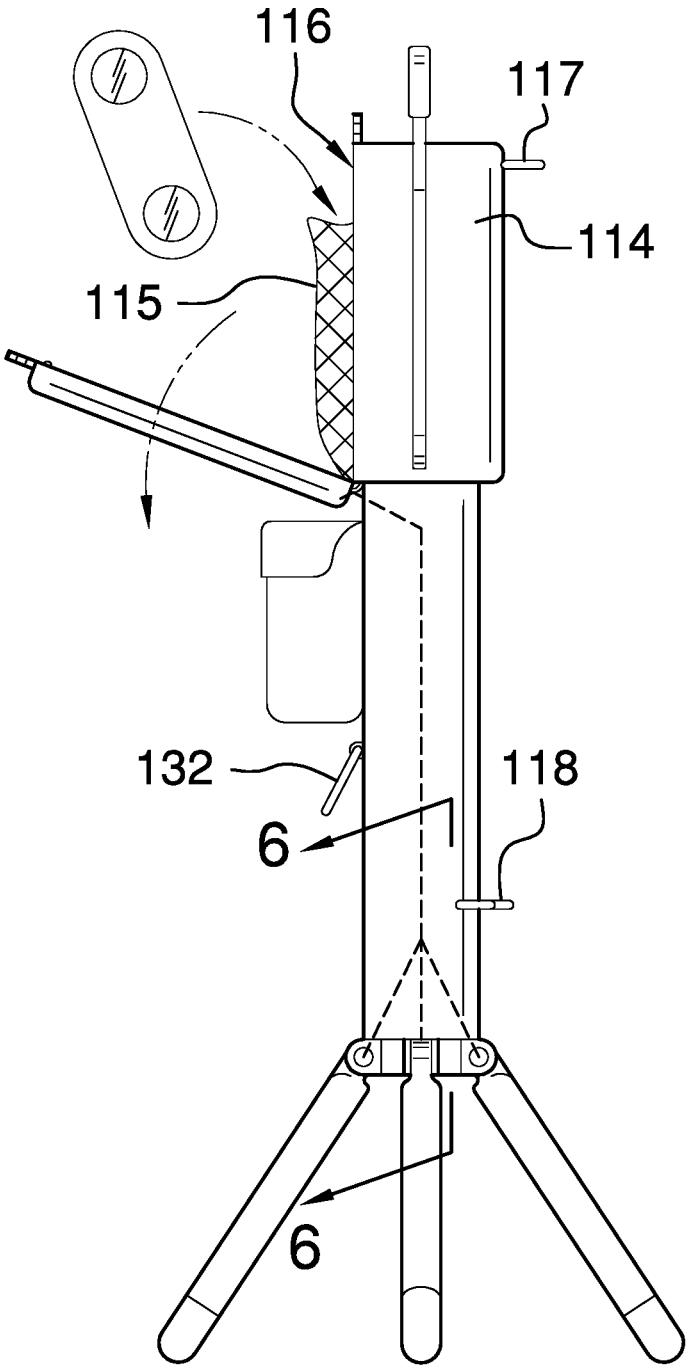
FIG. 4 is an alternate side view of an embodiment of the disclosure.
Figure 5:
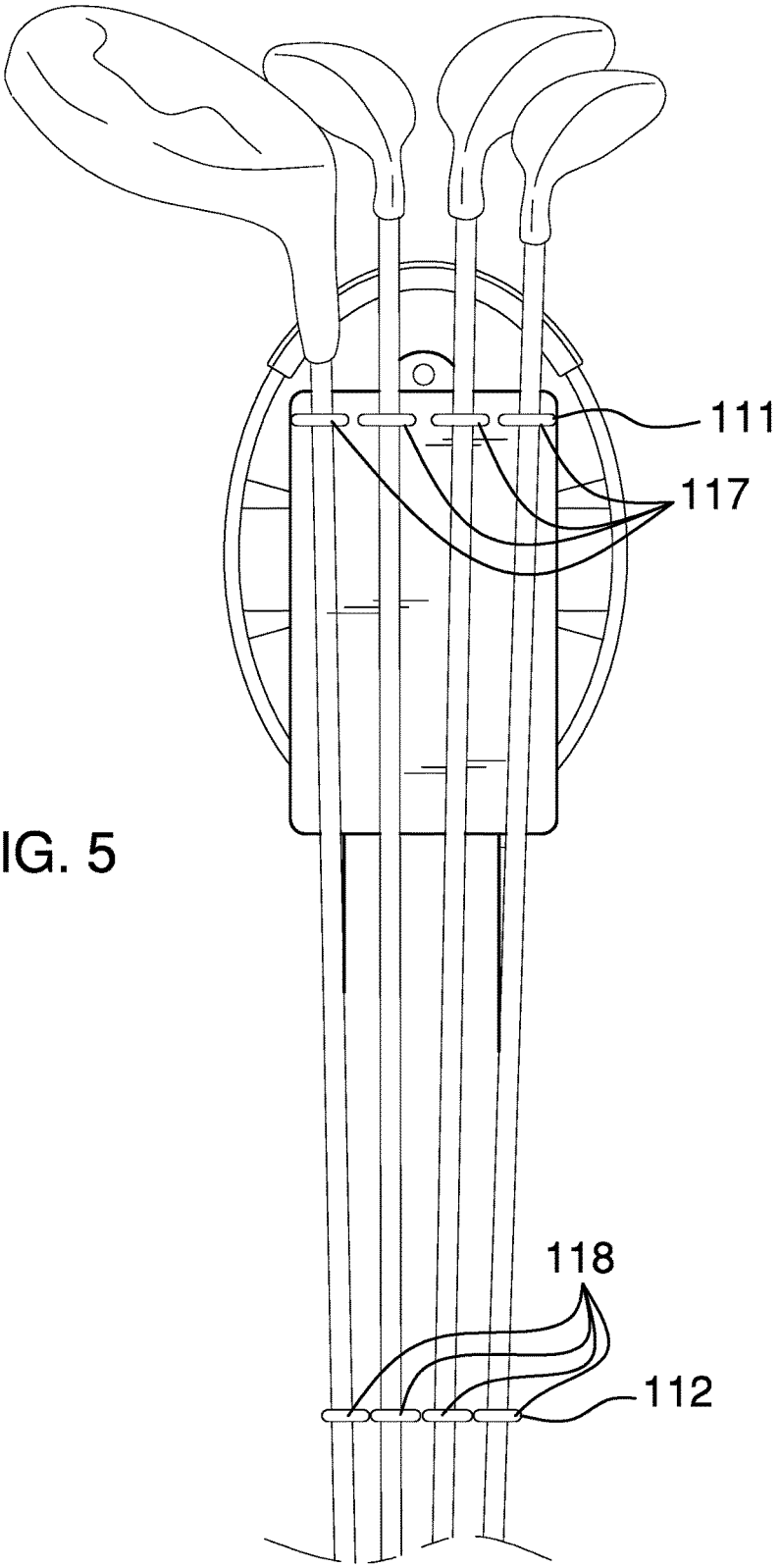
FIG. 5 is a detail view of an embodiment of the disclosure.
Figure 6:
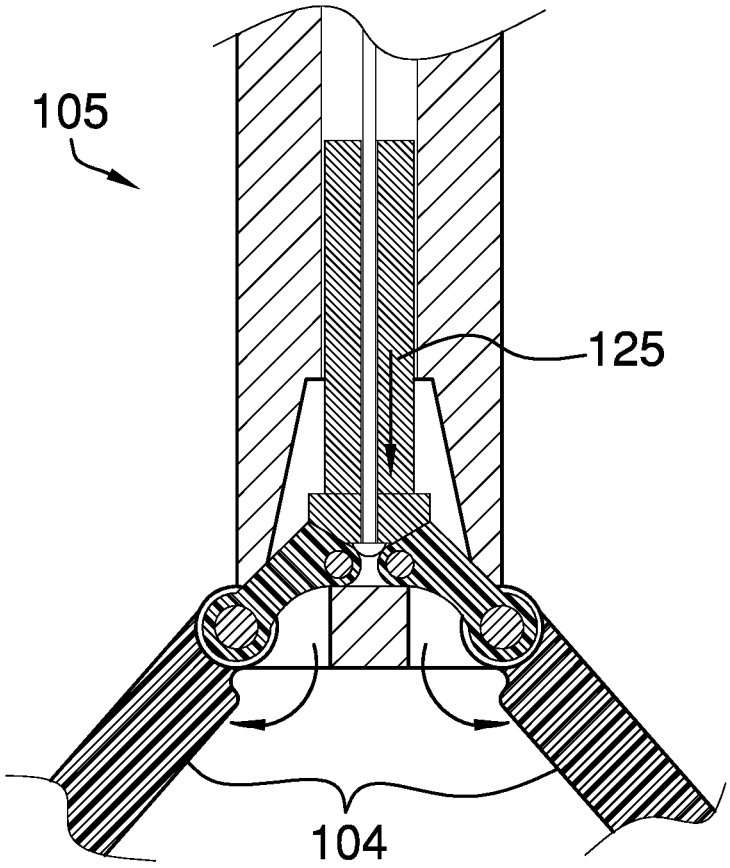
FIG. 6 is a cross-sectional view of an embodiment of the disclosure.

Detailed reference will now be made to a first potential embodiment of the disclosure, which is illustrated in FIGS. 1 through 6.

The golf club caddy 100 (hereinafter invention) comprises a plurality of club holders 101, a container 102, a cylinder 103, a plurality of legs 104, and a leg opening mechanism 105. The invention 100 is adapted for use in the game of golf. The invention 100 is a lightweight, portable carrier that is used to carry a plurality of golf clubs 151 as well as a plurality of accessories that may be required by the golfer. The invention 100 is a self-supporting structure that with sub-structures that are designed to carry the plurality of golf clubs 151, one or more towels 153, one or more golf balls 152, and tools such as range finders 154 or GPS locators.

The cylinder 103 is a rigid hollow cylinder that further comprises a third end 163 and a fourth end 164. The cylinder 103 further comprises a ball bag 131, a one or more clips or rings 132, and a strap 133. The exterior face 135 of the cylinder 103 has mounted on it the ball bag 131, the one or more clips or rings 132, and the strap 133. The ball bag 131 is a commercially available sleeve that is sized to carry one or more golf balls 152. The one or more clips or rings 132 are attachment devices such as commercially available "alligator" type clips that are used to hang towels, hats, and other objects such from the side of the cylinder 103. The strap 133 is a hook and loop fastener that is used to attach the invention 100 to the primary carrying bag used by the golfer.

The plurality of legs 104 is a plurality of limbs that are used to support the invention 100 in an upright position. Each of the plurality of legs 104 is a strut. The plurality of legs 104 is mounted at the fourth end 164 of the cylinder 103. In the first potential embodiment of the disclosure, the plurality of legs 104 comprises a first leg 121, a second leg 122, and a third leg 123. In the second potential embodiment of the disclosure, the plurality of legs 104 further comprises a fourth leg 124.

The leg opening mechanism 105 further comprises a deployment mechanism 125, a door 126, and a snap 127. The deployment mechanism 125 is a device that is used to extend the plurality of legs 104 in the direction away from the center axis of the cylinder 103. This provides greater stability when the plurality of legs 104 are supporting the invention 100 while reducing the footprint of the invention 100 when the invention 100 is being carried or is not in otherwise in use. The door 126 is the lever that is used to open and close the deployment mechanism 125. The snap 127 is a latch that is used to secure the door 126 in the closed position. The design and construction of deployment mechanisms are well known and documented in the art (for example: chapters 5 and 11 of The Mechanisms and Mechanical Devices Sourcebook by Neil Sclater $5^{th}$ Edition).

The container 102 further comprises a box 114 and a mesh 115. The container 102 is further defined with a first end 161 and a second end 162. The box 114 is a hollow case that is formed in the shape of a rectangular block with flat sides. The box 114 is formed with an open face 116 that allows access to the hollow interior of the box 114. The mesh 115 is a textile netting that is used to contain objects that are stored within the box 114. The open face 116 of the box 114 is enclosed via the door 126. The door 126 is attached to the box 114 such that when the door 126 is opened the door 126 activates a shaft or cable linkage 128 that activates the deployment mechanism 125 to spread the plurality of legs 104 into position. When the door 126 is closed, the shaft or cable linkage 128 returns to its original position which in turn returns the plurality of legs 104 to their original position. The snap 127 is mounted on the first end 161 of the container 102 such that it will latch the door 126 into position when the door 126 is closed. The second end 162 of the container 102 is attached to the third end 163 of the cylinder 103 and is formed with a port such that the shaft or cable linkage 128 can transit from the container 102 to the cylinder 103 and to the deployment mechanism 125 and the plurality of legs 104. The grip 113 is an oval shaped looped handle that is mounted on the container 102 to allow the invention 100 to be carried.

The plurality of club holders 101 further comprises a plurality of club head holders 111 and a plurality of club shaft holders 112. Each of the plurality of club head holders 111 is mounted on the face of the container 102 that is distal from the door 126. Each of the plurality of club head holders 111 is a first ring 117 that is formed on the surface of the container 102 such that the shaft of a golf club can be inserted through the first ring 117. Each of the plurality of club shaft holders 112 is a second ring 118 that is formed on the surface of the container 102 such that the shaft of a golf club can be inserted through the second ring 118. The plurality of club shaft holders 112 is mounted on the exterior face 135 of the cylinder 103. Each club head holder selected from the plurality of club head holders 111 is aligned with a club shaft holder selected from the plurality of club shaft holders 112 such that the shaft of a golf club can be inserted through a club head holder selected from the plurality of club head holders 111 and the associated club shaft holder selected from the plurality of club shaft holders 112 for storage in the invention 100.

To use the invention 100, plurality of golf clubs 151 is inserted into the plurality of club holders 101, tools such as range finders 154 or GPS locators are placed in the container 102, one or more golf balls 152 are placed in the ball bag 131 and a towel and other items are clipped to the cylinder 103. The invention 100 is carried to the lie and is stood on the ground by opening the door 126, which extends the plurality of legs 104. When the shot is completed, the door 126 is closed and the invention 100 is returned to the golf cart and attached to a golf bag using the strap 133.

The container 102, the cylinder 103, and the grip 113 are formed as a single unit from molded plastic. The door 126 is formed as a single unit from molded plastic. Suitable plastics include, but are not limited to, polyvinylchloride or high-density polyethylene. The deployment mechanism 125 is made from commercially and commonly available hardware. The plurality of legs 104 is commercially available. The ball bag 131, one or more clips or rings 132, the strap 133, the snap 127, and the mesh 115 are commercially available.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder like structure. When the center axes of two cylinder like structures share the same line, they are said to be aligned. When the center axes of two cylinder like structures do not share the same line they are said to be offset.

Cylinder: As used in this disclosure, a cylinder is a geometric solid defined by two identical flat and parallel ends that are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Footprint: As used in this disclosure, a footprint is the surface area occupied by an object.

Handle: As used in this disclosure, a handle is an object by which a tool, object, or door is held or manipulated with the hand.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fasten to the plurality of loops securely fastening the hook surface to the loop surface.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Textile: As used in this disclosure, a textile is a material that is woven, knitted, braided or felted. Synonyms in common usage for this definition include fabric and cloth.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A carrier comprising:

a plurality of club holders, a container, a cylinder, a plurality of legs, and a leg opening mechanism;

wherein the carrier is adapted for use in the game of golf;

wherein the carrier is adapted to carry a plurality of golf clubs;

wherein the carrier is adapted to carry a plurality of golf accessories;

wherein the carrier is a self-supporting structure;

wherein the self-supporting structure is designed with a plurality of substructures that are adapted to carry the plurality of golf accessories;

wherein the cylinder is a rigid hollow cylinder;

wherein the cylinder is further defined by a third end and a fourth end;

wherein the cylinder further comprises a ball bag, a one or more clips or rings, and a strap;

wherein the ball bag is mounted on the exterior face of the cylinder;

wherein the one or more clips or rings is mounted on the exterior face of the cylinder;

wherein the strap is mounted on the exterior face of the cylinder;

wherein the strap has a hook and loop fastener that is used to attach the carrier to the primary carrying bag used by the golfer;

wherein the plurality of legs are a plurality of limbs that are used to support the carrier in an upright position;

wherein each of the plurality of legs is a strut;

wherein the plurality of legs are mounted at the fourth end of the cylinder;

wherein the leg opening mechanism further comprises a deployment mechanism, a door, and a snap;

wherein the deployment mechanism is a device that is used to extend the plurality of legs in the direction away from the center axis of the cylinder;

wherein the door is the lever that is used to open and close the deployment mechanism.

2. The carrier according to claim 1 wherein the snap is a latch that is used to secure the door in the closed position.

3. The carrier according to claim 2 wherein the container comprises a box and a mesh;

wherein the container is further defined with a first end and a second end.

4. The carrier according to claim 3 wherein the box is a hollow case that is formed in the shape of a rectangular block with flat sides;

wherein the box is formed with an open face.

5. The carrier according to claim 4 wherein the door is attached to the box.

6. The carrier according to claim 5 wherein the second end of the container is attached to the third end of the cylinder.

7. The carrier according to claim 6 wherein the plurality of club holders further comprises a plurality of club head holders and a plurality of club shaft holders.

8. The carrier according to claim 7 wherein each of the plurality of club head holders comprises a first ring that is mounted on the container.

9. The carrier according to claim 8 wherein each of the plurality of club shaft holders comprises a second ring that is mounted on the cylinder.

10. The carrier according to claim 9 wherein the plurality of legs comprises a first leg, a second leg, and a third leg.

11. The carrier according to claim 10 wherein the plurality of legs further comprises a fourth leg.

* * * * *